United States Patent [19]

Ono et al.

[11] Patent Number: 4,947,211

[45] Date of Patent: Aug. 7, 1990

[54] DEVELOPING DEVICE

[75] Inventors: Taizo Ono; Yoshihiro Katayama, both of Hirakata; Toshi Saitoh, Suita, all of Japan

[73] Assignee: Matsushita Electric Industrial Co., Ltd., Kodama, Japan

[21] Appl. No.: 376,569

[22] Filed: Jul. 7, 1989

[30] Foreign Application Priority Data

| | | | |
|---|---|---|---|
| Dec. 2, 1986 | [JP] | Japan | 61-287015 |
| Dec. 4, 1986 | [JP] | Japan | 61-289221 |
| Dec. 4, 1986 | [JP] | Japan | 61-289222 |
| Jan. 12, 1987 | [JP] | Japan | 62-4370 |
| Jan. 12, 1987 | [JP] | Japan | 62-4371 |
| Jan. 12, 1987 | [JP] | Japan | 62-4372 |

[51] Int. Cl.[5] ..... G03G 15/08

[52] U.S. Cl. ..... 355/265; 355/259; 355/261; 355/264; 118/653

[58] Field of Search ..... 355/245, 251, 253, 259, 355/260, 261, 263, 264, 265; 118/653, 657, 658; 430/120, 122

[56] References Cited

U.S. PATENT DOCUMENTS

| | | | |
|---|---|---|---|
| 4,083,326 | 4/1978 | Kroll et al. | 118/661 |
| 4,377,334 | 3/1983 | Nishikawa | 355/3 DD |
| 4,378,158 | 3/1983 | Kanbe | 355/259 |
| 4,417,802 | 11/1983 | Forbes, II | 355/3 DD |
| 4,468,111 | 8/1984 | Yamagata et al. | 355/3 DD |
| 4,469,427 | 9/1984 | Kopp et al. | 355/3 DD |
| 4,498,756 | 2/1985 | Hosoya et al. | 355/3 DD |
| 4,666,283 | 5/1987 | Iida et al. | 355/14 D X |
| 4,766,457 | 8/1988 | Barker et al. | 355/14 D X |

FOREIGN PATENT DOCUMENTS

| | | |
|---|---|---|
| 2361418 | 6/1974 | Fed. Rep. of Germany . |
| 0087074 | 8/1983 | Fed. Rep. of Germany . |
| 54-43038 | 4/1979 | Japan . |
| 56-110963 | 9/1981 | Japan . |
| WO8807707 | 10/1988 | PCT Int'l Appl. . |

OTHER PUBLICATIONS

Patent Abstracts of Japan, vol. 10, No. 308 (P-508) (2364) Oct. 21, 1986 JP-A-61 121 071 (Toshiba Corp.) 06/09/86.

Patent Abstracts of Japan, vol. 7, No. 32 (P-174) (1177) Feb. 8, 1983 JP-A057 185 052 (Konishiroku Shashin Kogyo K.K.) 11/15/82.

Patent Abstracts of Japan, vol. 10, No. 202, (P-477) (2258) Jul. 15, 1986 JP-A-61 45 257 (Ricoh Co. Ltd.) 3/5/86.

Patent Abstracts of Japan, vol. 9, No. 113 (P-356) (1836), May 17, 1985 JP-A-59 232 370 (Toshiba K.K.) 12/27/84.

*Primary Examiner*—A. C. Prescott

*Attorney, Agent, or Firm*—Cushman, Darby & Cushman

[57] ABSTRACT

A developing device comprises a developer carrying means for carrying developer from a developer supplying means to an electrophotographic light-sensitive member having electrostatic latent image and a developer returning means for returning superfluous developer to the developer supplying means, thereby over-electrification of the developer is prevented.

19 Claims, 17 Drawing Sheets

DEVELOPING DEVICE

FIELD OF THE INVENTION

The present invention relates generally to electrophotography, and, more particularly, to a developing device thereof.

DESCRIPTION OF THE RELATED ART

Developing methods using a dry type developer are classified into a method using a two-component developer and a method using a one-component developer.

In the method using the two-component developer, since a mixed developer consisting of toner and carrier is used, a toner density controlling device is required to maintain a mixture-ratio of the toner and carrier at a predetermined constant value. Additionally, the carrier must be exchanged with a new one every predetermined time period because of its deterioration. Recently, in order to remove the above-mentioned drawback, a developing method using a one-component developer, which does not use the carrier, has been proposed.

The developing method is disclosed in the Japanese published unexamined patent applications Sho 54-43038 and Sho 56-110963, and U.S. Pat. No. 4,083,326, for example. These constitutions are shown in FIG. 1, FIG. 2, and FIG. 3, respectively.

As shown in FIG. 1 (Sho 54-43038), a developing roller 1 is composed of a cylindrical sleeve containing magnets 1A. Magnetic toner 2 is stored in a hopper 3 which is installed under the developing roller 1. A blade 4 contacts the surface of the developing roller 1. A photoreceptor 5 is disposed over the developing roller 1. The developing roller 1 has a rough surface made of a metal material, and the toner 2 is supplied to the surface of the developing roller 1 from the hopper 3. When the developing roller 1 rotates in the direction shown by arrow A, the toner 2 is electrified with a predetermined polarity by the blade 4 touching and sliding on the surface of the developing roller 1, and the toner 2 is coated on the surface of the developing roller 1. The toner 2, electrified with the predetermined polarity, transfers to the photoreceptor 5 where the toner adheres to an electrostatic latent image on the surface of the photoreceptor 5, and the electrostatic latent image is developed.

In the prior art, the toner on the surface layer of the developing roller 1 contacts the blade 4 and is electrified by friction. The excess toner, which is not used to develope the image on the developing roller 1, is further electrified by further contact with the blade 4. As a result, the toner is overelectrified, and difficulty is encountered in the reproduction of a high quality image.

FIG. 2 is a second conventional example in the prior art (Sho 56-110963). As shown in FIG. 2, a developing roller 7 made of electroconductive urethane is in contact with a photoreceptor 6. An electroconductive fur brush **8*a* is in contact with the developing roller 7. A power source 9 applies an electric potential to the fur brush 8*a* and the developing roller 7. An electric potential distributor 10 controls an electric potential of the power source 9. Toner 12 is stored in a hopper 11. Toner 12 supplied to an electroconductive fur brush 8*b* from the hopper 11 is supplied to the fur brush 8*a*. The toner supplied to the fur brush 8*a* via the fur brush 8*b* is electrified by the friction of the fur brushes 8*a* and 8*b*. Then the toner is coated on the surface of the developing roller 7 from the fur brush 8*a* by the electric potential of the power source 9. The toner on the developing roller 7 adheres to an electrostatic latent image of the photoreceptor 6. In the above-mentioned process, the developing density is adjusted by the electric potential which is controlled by the electric potential distributor 10**.

In the above-mentioned prior art, the toner electrified on the fur brush **8*a* is coated on the developing roller 7 as a function of the electric field between the fur brush 8*a* and the developing roller 7. Therefore, residual the toner on the developing roller 7 and in the fur brush 8*a* that which is not used to develop the image is further electrified by friction between the developing roller 7 and fur brush 8*a*. Moreover, since the toner 12 is supplied from the hopper 11 disposed over the fur brush 8*a* and 8*b*, surplus toner is likely to fill the fur brushes 8*a* and 8*b***. As a result, the toner is overelectrified, and difficult in reproducing a high quality image is encountered.

FIG. 3 shows a prior art in design as disclosed in the U.S. Pat. No. 4,083,326. As shown in FIG. 3, two electroconductive fur brushes 18 and 19 arranged in a hopper 15 are in contact with the developing roller 13. A sheet-shaped photoreceptor 17 is disposed over the developing roller 13. A blade 16 is also in contact with the developing roller 13. A first power source 20 provides an electric potential across the hopper 15 and the fur brush 18. A second power source 21 provides an electric potential across the fur brush 19 and the hopper 15. The voltage of the second power source 21 is higher than that of the first power source 20, and is lower than the electric potential of the electrostatic latent image of the photoreceptor 17. The toner 14, which is frictionally electrified by the fur brush 18, is supplied to the developing roller 13 via the fur brush 18 by a potential difference between the power sources 20 and 21. The toner supplied to the developing roller 13 is flattened by the blade 16. Then, the toner 14 adheres to the electrostatic latent image on the photoreceptor 17. The residual toner 14 remaining on the developer roller 13 after developing is scraped by the fur brush 19 and any ghosting on the developing roller 13 is removed.

In the above-mentioned prior art, the electrified toner on the fur brush is coated on the developing roller by one of the two fur brushes, and the toner electrified remaining on the developing roller after the developing process is removed by the other fur brush. In the example, over-electrification of the toner on the developing roller is prevented. However, the toner in the fur brush which is not used in developing is repeatedly rubbed with the developing roller 13 and further electrified by friction, thereby over-electrification is liable to occur, and difficult in obtaining a high quality image is encountered.

OBJECT AND SUMMARY OF THE INVENTION

An object of the present invention is to provide a developing device capable of reproducing a high quality image by preventing over-electrification of the toner in the developing device.

The developing device in accordance with the present invention comprises:

an electrophotographic light-sensitive member having an electrostatic latent image.

a developer storing means for storing developer therein, developer carrying means for carrying developer to the electrophotographic light-sensitive member from the developer storing means, object supplying means for supplying developer to the developer carrying means installed in the developer storing means, and developer returning means for returning developer from the developer carrying means to the developer storing means.

DESCRIPTION OF THE PREFERRED EMBODIMENT

Figure 1:
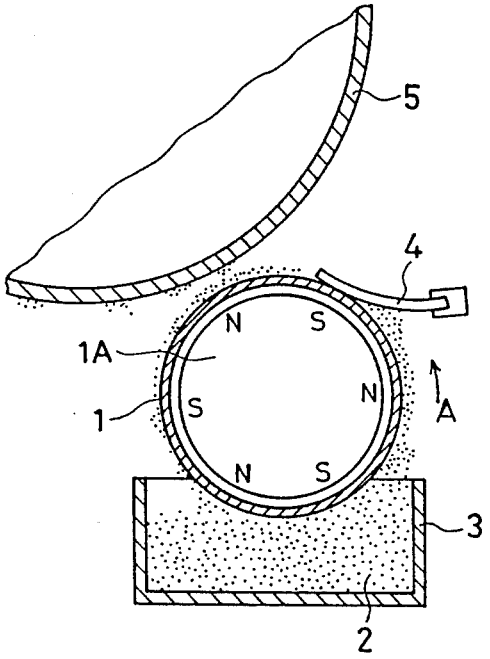
FIG.1 (Prior Art)
FIG. 1, FIG. 2, and FIG. 3 are cross-sectional views showing main the portion of the developing devices using the one-component developer in the prior art.
Figure 2:
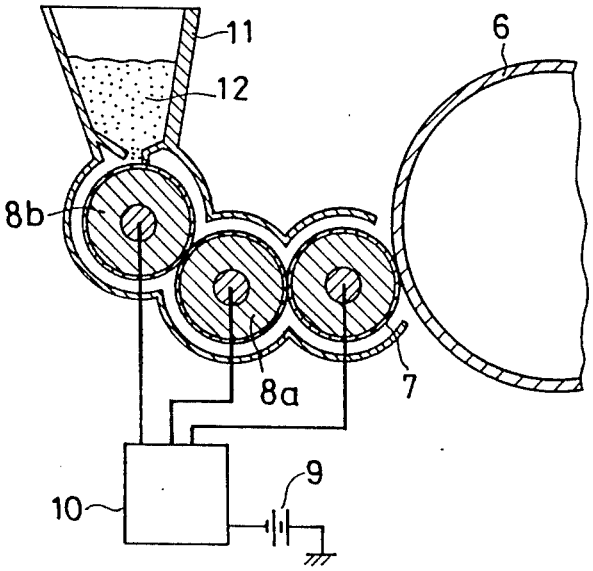
FIG.2 (Prior Art)
Figure 3:
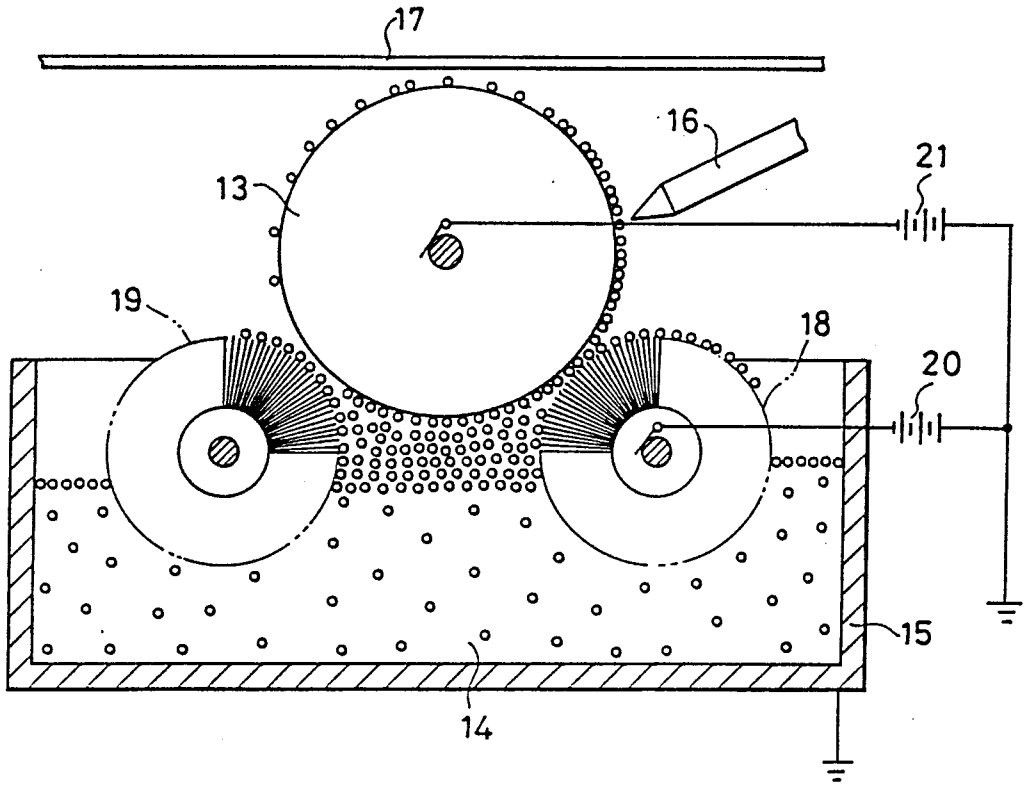
FIG.3 (Prior Art)
Figure 4:
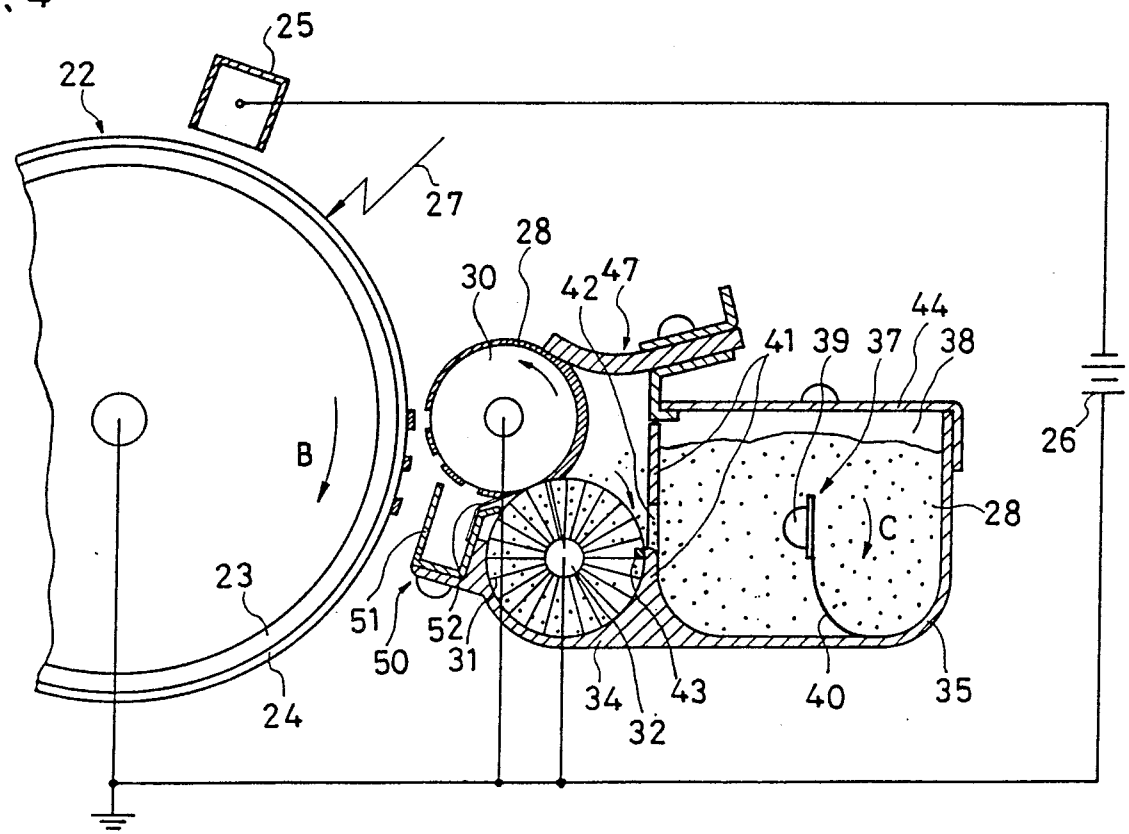
FIG. 4 is a cross-sectional view showing the main portion of a developing device of a first embodiment in accordance with the present invention.

FIG. 4 is a cross-sectional view showing a developing device of an electrophotographic copier in a first embodiment in accordance with the present invention. As shown in FIG. 4, a photoreceptor drum 22 functions as an electrostatic electrification member and is made of a photoconductive material 24 such as zinc oxion, selenium, or an organic photoconductive material which is formed on an aluminium drum 23. The photoconductive material 24 on the whole surface of the photoreceptor drum 22 is electrified by an electrifying electrode 25. Polarity of electrification is negative in the zinc oxide, and is positive in selenium. An electrostatic latent image is formed on the photoreceptor drum by projection of a light pattern 27 by an optical means (not shown). In the embodiment, a regular one-component nonconductive toner is used as a developer 28, althrough a magnetic toner or nonmagnetic toner is also usable as the developer 28. A developer carrying means comprises a developing roller 30 and a cylindrical elastic member 31. The developer roller 30 is a metal roller made of stainless steel aluminum, or is a roller which is coated by plastic on the surface of the metal roller.

Figure 5:
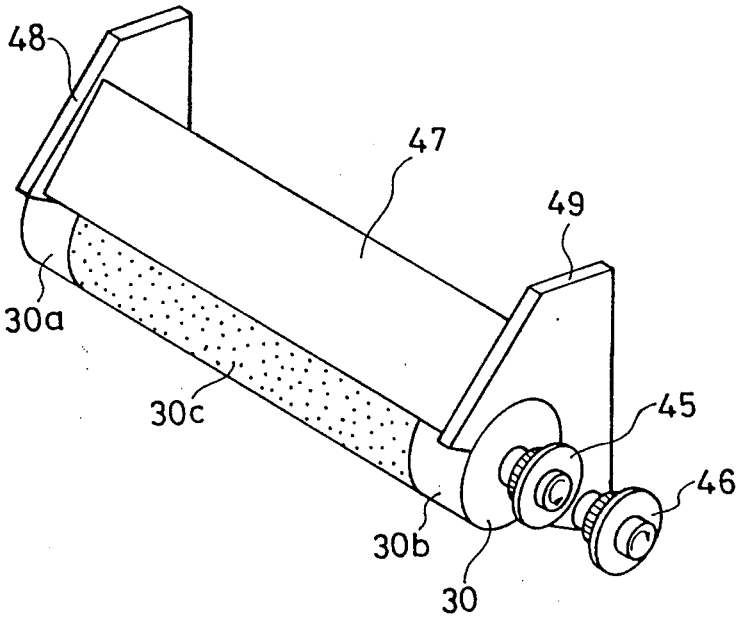
FIG. 5 is a perspective view showing a main portion of the developing device in the first embodiment.
Figure 6:
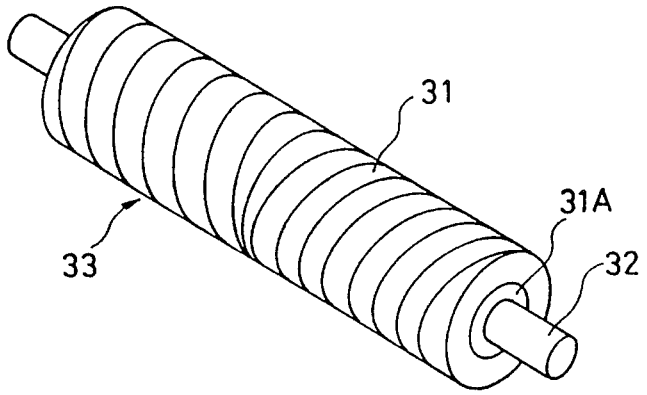
FIG. 6 is a perspective view of a fur brush.

FIG. 5 is a perspective view of the developing roller 30. As shown in FIG. 5, the developing roller 30 has smooth surfaces on both end portions **30*a* and 30*b*, and a rough surface having fine protrusions on the surface of the central portion 30*c*. The developing roller 30 as shown in FIG. 4 is mounted with a predetermined spacing or interval relative to the photoreceptor drum 22, and is rotated counterclockwise, for example. The cylindrical elastic member 33 is generally composed of a fur brush 31 and a sponge 31A, and a layer of elastic member 33 is formed on the outer surface of a metal shaft 32. In the embodiment, only the fur brush 31 is used as the cylindrical elastic member 33, which is made of electroconductive fur using rayon fibers containing carbon. The fur brush 31 is enclosed in a housing 34. The surface of the fur brush 31 is in contact with the surface of the developing roller 30, and is rotated clockwise with a rotating speed which is faster than the developing roller 30 in circumferential speeds, thereby the amount of the developer 28 which is supplied to the developing roller 30 increases, and a follow-up characteristic on the coating is improved. Moreover, spillage of the developer 28 can be reduced, and the ghosting of the developing roller 30 can be erased by scraping the developer 28 adhered on the surface of the developing roller 30 after the developing process. Fibers of the fur brush 31, as shown in FIG. 6, are arranged in spiral shape so that the developer 28 is moved to the central portion from both end portions of the fur brush 31 by rotation thereof. A developer storing container 35 has a first supplying means 37 for supplying the developer 28 to the fur brush 31 therein. The developer storing container 35 is composed as a portion of the housing 34 shown in FIG. 8, and an opening 38 (FIG. 4) for supplying the developer 28** is disposed on the upper portion thereof.

The first supplying means 37 comprises a sheet-shaped elastic member 40 which is fixed on a shaft 39 at an end portion. The elastic member 40 is made of a polyethyleneterephthalate sheet of 30 microns thick. The developer 28 is supplied to the fur brush 31 by rotation or shaking of the shaft 39. In the embodiment, the shaft 39 is rotated clockwise. A partition plate 41 (FIG. 4) is disposed between the developer storing container 35 and the fur brush 31 and is provided with an opening 42 wherethrough the developer 28 flows in or flows out between the developer storing container 35 and the fur brush 31. A scraper 43 is formed as a part of the housing 34. The scraper 43 the makes amount of the developer 28 contained in the fur brush 31 uniform by rubbing the fur brush 31, and scrapes the overelectrified developer 28 of from the fur brush 31. The opening 38 for supplying the developer 28 is usually closed by a lid 44. As shown in FIG. 5, the developing roller 30 is held by bearings 45, and the fur brush 31 is held by bearings 46.

A thickness restricted means 47 serves to restrict the thickness of the developer 28. In the embodiment, a rubber blade made of an elastic material such as urethane rubber is used therefor. The thickness restriction means 47 can be made of other rubber materials elastic plastics such as polyethyleneterephthalate, or a metal spring made of phosphorbronze or spring steel. Moreover a spring metal or plastic member coated with fluorine plastic is usable. Since the linearity or straightness of the edge of the thickness restriction means 47 sharply influences the formation of a uniform thin layer of the developer 28, the edge of the thickness restriction means 47 is linear with 0.15 mm. The thickness restricted means 47, as shown in FIG. 4, is arranged to contact the surface of the developing roller 30 at its edge at a position in advance of the developer 28 layer facing the surface of the photoreceptor drum 22. The width of the thickness restriction means 47, as shown in FIG. 5, is made to contact both the end portions 30*a* and 30*b* of the developing roller 30. Seal members 48 and 49 for preventing leakage of the developer 28, made of a fabric, nonwoven fabric (felt), sponge or elastic member such as rubber, are mounted on the respective end portions 30*a* and 30*b* of the developing roller 30, and the respective side faces of the thickness restriction means 47 contact the seal members 48 and 49.

Figure 7:
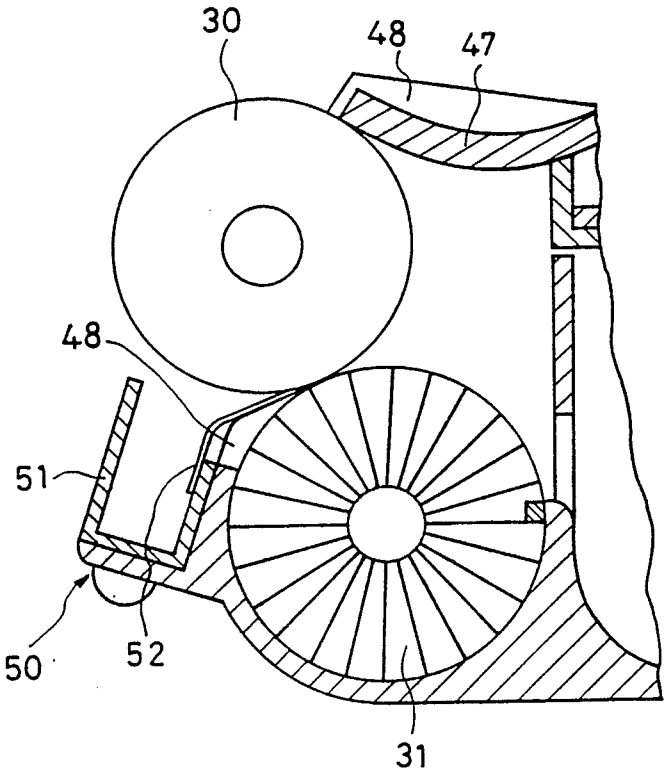
FIG. 7 is a cross-sectional view showing a detailed constitution of the main portion in the first embodimentf

A scatter preventing means 50 of the developer 28, as shown in FIG. 4, is disposed under the developing roller 30 and at a position in advance of the nip between the fur brush 31 and the developing roller 30. The scatter preventing means 50 is composed by a U-shaped scatter preventing member 51 and a scatter preventing sheet 52 touching the surface of the developing roller 30 at one edge and mounted on the scatter preventing member 51 at another end. The scatter preventing sheet 52 can be fixed on the housing 34 at its one end. As shown in FIG. 7, the width of the scatter preventing sheet 52 is selected to reach both the end surfaces 30*a* and 30*b* of the developing roller 30. Both ends of the scatter preventing sheet 52 are pressed against the developing roller 30 by the seal members 48 and 49 set on both ends of the developing roller 30. The edge portion of the scatter preventing sheet 52 contacts the surface of the developing roller 30 at a left portion from a line connecting the respective centers of the developing roller 30 and fur brush 31. The scatter preventing sheet 52 is made of an elastic material such as polyethyleneterephthalate or urethane rubber. In the embodiment, urethane rubber, which is capable of closely contacting the developing roller 30, is used. Its preferable thickness is 50–200 microns. The scatter preventing member 51 is made of metal, such as stainless steel or aluminum. The scatter preventing member 51 receives the developer 28 scattered from gap between the developing roller 30 and the scatter preventing sheet 52. In the ususal use, scattering of the developer 28 is prevented by the scatter preventing sheet 52, and a scatter preventing member 51 having a small capacity is suitable.

In the case where conductive material is used for the fur brush 31, over-electrification of the developer 28 by friction on the developing roller 30 is prevented, and its potential is uniform. Therefore, it is preferable that the fur brush 31 is made of a conductive material having a specific resistance of under $10^{10}$ ohm cm, preferable $10^3$ ohm cm–$10^7$ ohm cm. The fur brush 31 can be made of other conductive fibers in place of the conductive rayon fibers in the embodiment. Using a fur brush made by the "electrostatic fur setting method" is effective to provide a uniform coating of the developer 28. Even if an electric conductive sponge, electric conductive cloth, or soft wire-brush is used for the elastic member 33 of the fur brush 31, the friction electrification and coating of the developer are effectively accomplished.

In the case where the developer 28 is a one-component magnetic toner, a magnetic roller for the shaft 32 is used, and the magnetic brush is formed on the outer surface thereof as the elastic member 33.

Operation of the developing device in the above-mentioned embodiment is elucidated hereinafter.

In the experiment of the embodiment, the photoreceptor 24 on the photoreceptor drum 22 is zinc oxide. The circular elastic member 33 is a fur brush wherein rayon fibers including carbon having a specific resistance of about $10^5$ ohm cm are mounted on the shaft 32 made of aluminum, a fiber density of about 3600/cm$^2$ being suitable. Surface roughness of the developing roller 30 is 5 R maximum. The line pressure of the thickness restriction means 47 pressing against the developing roller 30 is 25 g/cm. A gap between the photoreceptor drum 22 and the developing roller 30 is 0.15 mm. Non-magnetic one-component toner of positive electrification is used as the developer 28.

As shwon in FIG. 4, the surface of the photoreceptor drum 22 is electrified to −600 V by a negative corona by impressing −6 KV on the electrifying electrode 25 from the first high voltage DC power source 26.

Subsequently, a reflected image of an original document (not shown), for example, illuminated by a halogen lamp, is projected into the photoreceptor drum 22 through an optical system (not shown), and an electrification potential on the surface of the photoreceptor drum 22 corresponding to the white portion of the original document is reduced to almost zero volts by the reflected light, thereby a positive electrostatic latent image is formed.

On the other hand, the developer 28 in the storing container 35 is supplied to the fur brush 31 via the opening 42 by the first supplying means 37. Then, superfluous developer 28 in the fur brush 31 is scraped by the scraper 43, and a suitable amount of the developer 28 is supplied. The developer 28 in the fur brush 31 is electrified to a postive potential by the friction between the scraper 43 and the housing 34. An electric field is generated between the developing roller 30 and the fur brush 31 by the electrified developer 28 in the fur brush 31, and the electrified developer 28 is coated onto the surface of the developing roller 30. In the step, the developer 28 supplied to the fur brush 31 is further uniformly electrified to a positive potential by friction on the surface of the developing roller 30, which friction is caused by rotation of the fur brush 31. Since the electric potential is not applied across the developing roller 30 and the fur brush 31 and the fur brush 31 is insulated from the housing 34, the uniformly electrified developer 28 is coated on the developing roller 30. A thickness of the developer 28 on the surface of the developing roller 30 coated by the above-mentioned step is larger than a desirable value, and there is a slight unevenness.

Subsequently, the outer surface portion of the developer 28 on the developing roller 30 is scraped by the thickness restriction means 47 by rotation of the developing roller 30, and the thickness is restricted to about 40 microns (10 microns–70 mircons is desirable). Since the straightness of the edge of the thickness restriction means 47 is under 0.15 mm, the coating of the developer 28 on the developing roller 30 is realized without an unevenness of the thickness or grooves. In the above-mentioned step, though the developer 28 scraped by the thickness restriction means 47 tends to fall on both the end portion of the fur brush 31, the developer 28 is transferred to the central portion from both the end portion of the fur brush 31 by rotation of the fur brush, which has its fur aligned spirally as shown in FIG. 6. As a result, the developer 28 does not gather on both the end portions of the developing roller 30 and fur brush 31, and the developer 28, which is returned in the developer storing container 35, is maintained at an even level. Since the seal members 48 and 49 touching both the side faces of the thickness restriction means 47 are in contact with the smooth surfaces 30*a* and 30*b* of both the end portions of the developing roller 30, wear of the seal members 48 and 49 due to rotation of the developing roller 30 is very little and scattering or leakage of the developer 28 is prevented. Since the surfaces of the seal members 48 and 49, which contact the thickness restriction member 47 and the developing roller 30, are smooth, there are no gaps at those contacting portions. Therefore, the developer 28 flowing along the axis of the developing roller 30 does not leak to the outside, and thereby a high quality image which is free from photographic fog is obtainable.

When the electrostatic latent image electrified with a negative potential on the photoreceptor drum 22 faces the developer 28 electrified with a positive potential on the developing roller 30, the developer 28 is transferred to the photoreceptor drum 22 by the static force of the electrostatic latent image on the photoreceptor drum 22, and the latent image is developed. The residual developer 28 on the developing roller 30 which is not used to develop the image is carried with the developing roller 30 downward and past the scatter preventing sheet 52. Though the scatter preventing sheet 52 contacts the developing roller 30, since the developer 28 ahderes to the developer roller 30 by electrostatic force, it does not fall in the scatter preventing member 51. The developer 28 carried past the scatter preventing sheet 52 does not leak out of the housing 34. Finally, the developer 28 adhering to on the surface of the developing roller 30 is scraped by the fur brush 31, and the ghost is erased. As a result, a high quality image is obtainable. The developer 28 scraped by the fur brush 31 is carried by the fur brush 31, and is further scraped by the scraper 43 and is returned to the developer storing container 35 through the opening portion 42. Therefore, the developer 28 on the developing roller 30 is not over-electrified.

Figure 8:
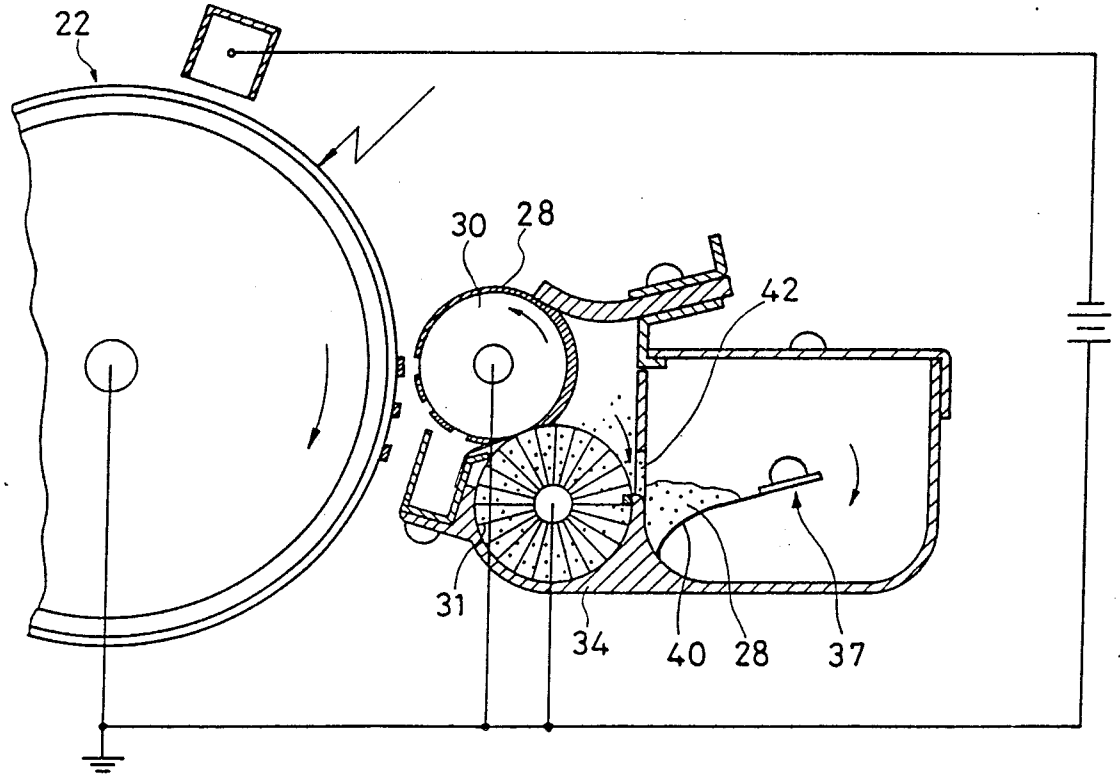
FIG. 8 is a cross-sectional view showing the main portion of the developing device of the first embodiment.

When the developer 28 in the developer storing container 35 is consumed and decreases, the sheet-shaped elastic member 40 is rotated clockwise and attains at the position as shown in FIG. 8, and thereby the developer 28 is 'swept' toward and pushed up to the opening portion 42. All the developer 28 in the developer storing container 35 can be supplied to the fur brush 31, even if the bottom of the developer storing container 35 is flat. Furthermore, since the developer 28 is agitated by the sheet-shaped elastic member 40 in the developer storing container 35, the level of the developer 28 in the developer storing container 35 is maintained evenly. Since the circumferential speeds of the developing roller 30 is identical with that of the photoreceptor drum 22, an edge defect in developing the image can be prevented.

In the developing device of the embodiment, since the residual developer which is not used in developing is retured to the developer storing container 35 through the opening 42, over-electrification of the developer is prevented. Moreover, since supplying of the developer to the developing 28 roller 30 and scraping of the developer 28 after the developing step are accomplished by one fur brush, the developing device is simple in constitution and small in size. Furthermore, since scattering and leakage of the developer 28 are prevented, the developing device is not restricted in arrangement. In the embodiment, the present invention is applied to positive-positive dye developing in the electrophotographic copier, but can also be applied to negative-positive dye developing in the laser printer, for example.

Figure 9:
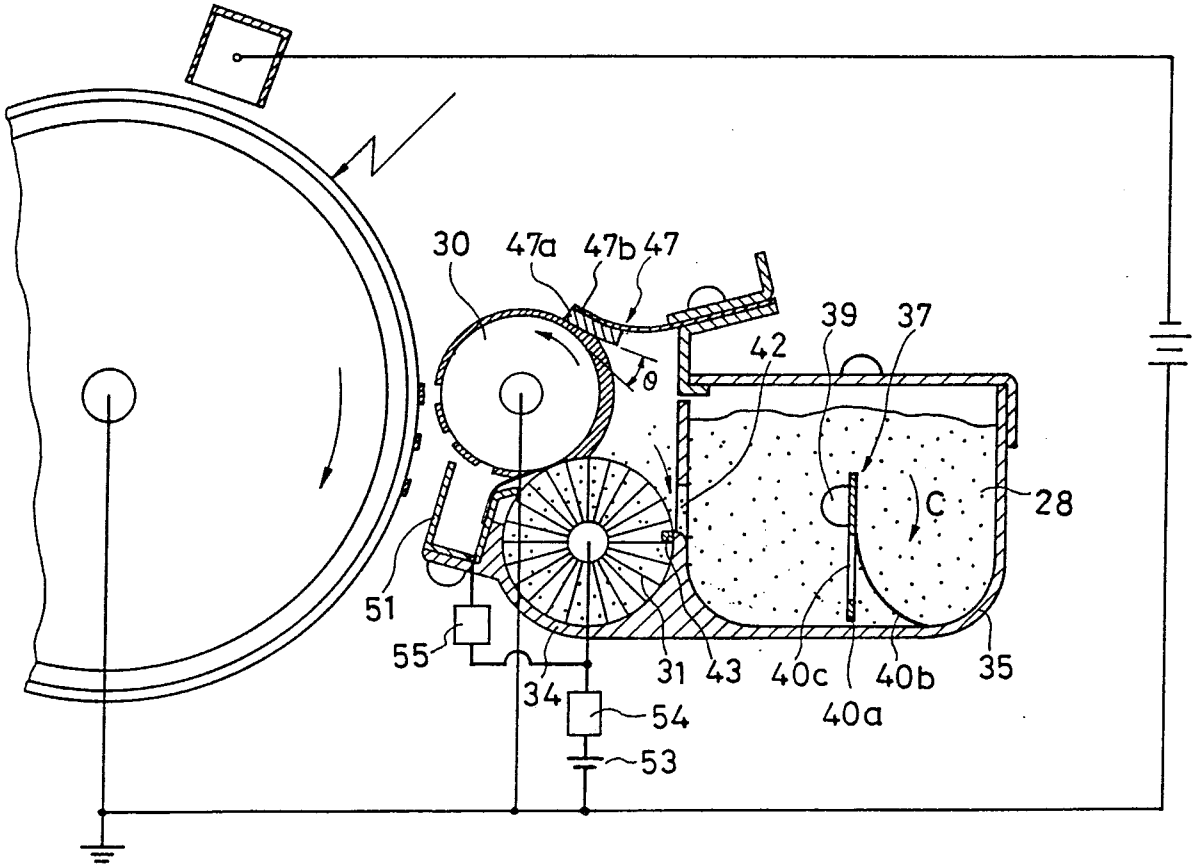
FIG. 9 is a cross-sectional view showing a main portion of the developing device in a second embodiment.

FIG. 9 is a cross-sectional view of a developing device of a second embodiment in accordance with the present invention, wherein elements similar to the elements of FIG. 4 are identified by like numerals. The first supplying means 37 comprises at least two plates 40*a* and 40*b* on the outer surface of the shaft 39, and the shaft 39 is rotated in the developer storing container 35. The fore plate 40*a* with respect to the rotating direction of the shaft 39 as shown by an arrow C is more resilient than the rear plate 40*b* in elastic force. The end portion of the plate 40*b* lightly contacts the inner wall of the developer storing container 35. On the other hand, the end portion of the plate 40*a* is spaced apart from the inner wall of the developer storing container 35 with a predetermined, small spacing or interval. The plate 40*a* is provided with an opening 40*c*.

In the embodiment, the plate 40*b* is made of a sheet-shaped elastic material such as polyethyleneterephthalate of 30 microns in thickness, rubber material such as urethane or neoprene, elastic plastic film such as polystyrene or Teflon (Trademark), elastic metal such as phosphor bronze or spring steel are usable as elastic material. Though the plate 40*a* is made of an aluminum solid member, a metal plate such as stainless steel, metal plate coated with fluorine plastics, hard plastic, or ceramics are usable as the solid member. The shaft 39 is rotated clockwise. In the embodiment, the thickness restriction the means 47 for restricting thickness of the layer of the developer is pressed against the developing roller 30, and thereby, the thickness of the developer 28 is restricted to a predetermined value without precise adjustment. The thickness restriction means 47 comprises at least two plates, a plate 47*a* contacting the developing roller 30 is joined on end of the other plate 47*b*. The plate 47*a* is lower than the plate 47*b* in the elastic coefficient. In the embodiment, though the plate 47*a* made of urethane rubber and the plate 47*b* made of phosphor bronze plate are joined in one body, other rubber material or elastic plastic is usable for the plate 47*a*, and elastic material such as spring steel is usable for the plate 47*b*.

Since the fur brush 31 is slower than the developing roller 30 in the circumferential speed, the developer 28 adhered to the surface of the developing roller 30 is scraped after the developing step. A second DC high voltage power source 53 applies a voltage across the developing roller 30 and fur brush 31, thereby to adjust the thickness of the developer 28 electrified on the surface of the developing roller 30. A sensing means 54 detects the current of the second DC high voltage power source 53, and detects the presence of the developer 28. A third voltage applying means 55 applies a voltage across the fur brush 31 and scatter preventing member 51, thereby to prevent leakage of the developer 28 by attraction of the fur brush 31 to the developer 28.

Operation of the second emobodiment is elucidated hereinafter. The developer 28 is supplied to the fur brush 31 by the first supplying means 37 through the opening 42. In the supplying step, when a lot of the developer 28 is stored in the developer storing container 35, the developer 28 is mainly transferred by the plate 40*a* having a high elastic force, and when the developer 28 is consumed and only a little developer 28 remains, the developer 28 on the bottom and inner wall of the developer storing container 35 is transferred by the plate 40*b* having a lower elastic force. Thereby, the developer 28 is not damaged and can be supplied in the fur brush 31. Moreover, since the plate 40*a* has the opening 40*c*, the developer 28 is not held between the plate 40*a* and 40*b*, a constant amount of the developer 28 is trransferred. Though the edge of the plate 40*b* is in light contact on the inner wall of the developer storing container 35 and the edge of the plate 40*a* is arranged with a small spacing or interval relative to the inner wall of the developer storing container 35 in the embodiment, it is available that the plate 40*b* is longer than the plate 40*a* in the direction of the inner wall and is arranged so as to close the inner wall with a short interval. In the above-mentioned state, the bending angle of the plate 40*b* is varied by the amount of the developer 28 in the storing container 35.

When a large amount of developer 28 is stored in the developer storing container 35, the plate 40*b* is bent by a load of the developer 28, and the greater part of the developer 28 is transferred by the plate 40*a*. When the developer 28 decreases in the developer storing container 35, the plate 40*b* returns to an original shape by elastic force, and the developer 28 which is on the inner wall of the developer storing container 35 is transferred by the plate 40*b*. Consequently, all the developer 28 is supplied to the fur brush 31 without damage to the developer 28.

The superfluous developer 28 in the fur brush 31 is scraped by the scraper 43, and suitable amount of the developer 28 is supplied. The developer 28 is electrified with a positive potential by friction between the developer and the scrapper 43 and the housing 34. Then, the developer 28 is transferred to the position contacting the developing roller 30 by rotation of the fur brush 31, and the electrified developer 28 is coated on the developing roller 30. Next, a DC voltage from the second high voltage DC power source 53 is applied across the developing roller 30 and the fur brush 31, thereby to adjust the thickness of the developer 28 on the surface of the developing roller 30. In the above-mentioned step, the thickness of the developer 28 is adjustable by change of the voltage from $\pm 30$ V to $\pm 250$ V.

For instance, in the case where a positive voltage of the second high voltage DC power source 53 is applied to the fur brush 31 and a negative voltage thereof is applied to the developing roller 30, in transferring the developer 28 from the fur brush 31 to the developing roller 30, such developer which is not electrified or is electrified in reverse polarity has a low probability of being transferred. Consequently, only the developer 28 electrified in normal polarity is transferred and contributes to developing, and thereby a fine image is obtainable.

In the above-mentioned developing process, since a suitable amount of the developer 28 exists in the fur brush 31, the contact resistance between the fur brush 31 and the developing roller 30 is sufficiently high, and hence a current sensed by the detecting means 54 is small. When the developer 28 in the developer storing container 35 and fur brush 31 is consumed by repeated operation, the contact resistance decreases, and, on the contrary, the current sensed by the detecting means 54 increases. As a result, the presence of the developer 28 in the developer storing container 35 can be detected by the current value sensed by the detecting means 54. Since the developer 28 is agitated by the plates 40*a* and 40*b* in the developer storing container 35, the developer 28 in the developer storing container 35 is evened. The thickness of the developer 28 on the surface of the developing roller 30, which is adjusted by a voltage applied from the second high voltage DC power source 53, is thicker than a preferable value, and hence the thickness is slightly uneven. Since the developer 28 in the fur brush 31 is transferred to the developing roller 30 by the electric potential of the second high voltage DC power source 53, the rise time for forming a predetermined thickness of the developer 28 is within one second.

The developer 28 on the surface of the developing roller 30 passes the thickness restriction means 47 by rotation of the developing roller 30, and hence is further electrified to a positive potential by the thickness restriction means 47. A part of the developer 28 on the developing roller 30 is scraped by the thickness restriction means 47 and is restricted within a predetermined thickness. Namely, since the plate 47*a* of the thickness restriction means 47 touching the developing roller 30 is made of a urethane rubber layer having a small elastic coefficient, the plate 47*a* evenly contacts the developer 28 on the developing roller 30. An angle $\theta$ between the surface of the developing roller 30 and the plate 47*a* is preferably as large as 30°, and thereby accumulation of the developer 28 between the developing roller 30 and the thickness restriction means 47 is reduced and the thickness of the developer 28 on the developing roller 30 can be restricted to a predetermined thickness. As a result, a high quality image having no unevenness in density is obtainable.

Subsequently, the electrostatic latent image on the photoreceptor 22 electrified with a negative potential faces the developer 28 on the developing roller 30, which is electrified with a positive potential, and hence the developer 28 is transported to the photoreceptor 22 by the electrostatic force of the electrostatic latent image on the photoreceptor 22, and the latent image is developed. After developing, the developer 28 adhering to the surface of the developing roller 30 is scraped by the fur brush 31, and hence the ghost of the developing roller 30 is erased, and thereby a high quality image having no ghost is obtainable. The developer 28 scraped by the fur brush 31 and transferred by the fur brush 31 is then scraped by the scraper 43 and is returned to the developer storing container 35 through the opening 42. Therefore, the developer 28 on the developing roller 30 is not over-electrified.

Figure 10:
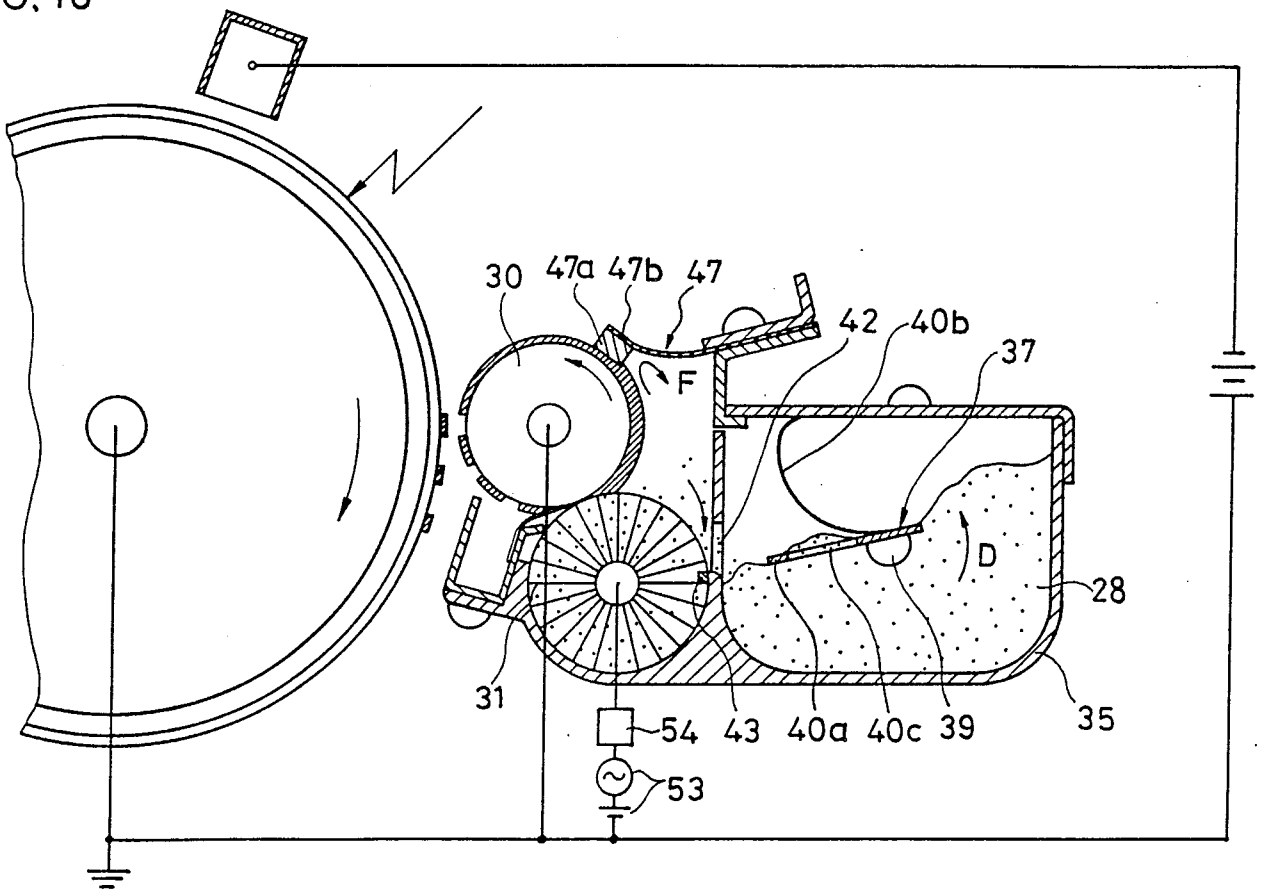
FIG. 10 is a cross-sectional view showning a main portion of the developing device in a third embodiment.
Figure 11:
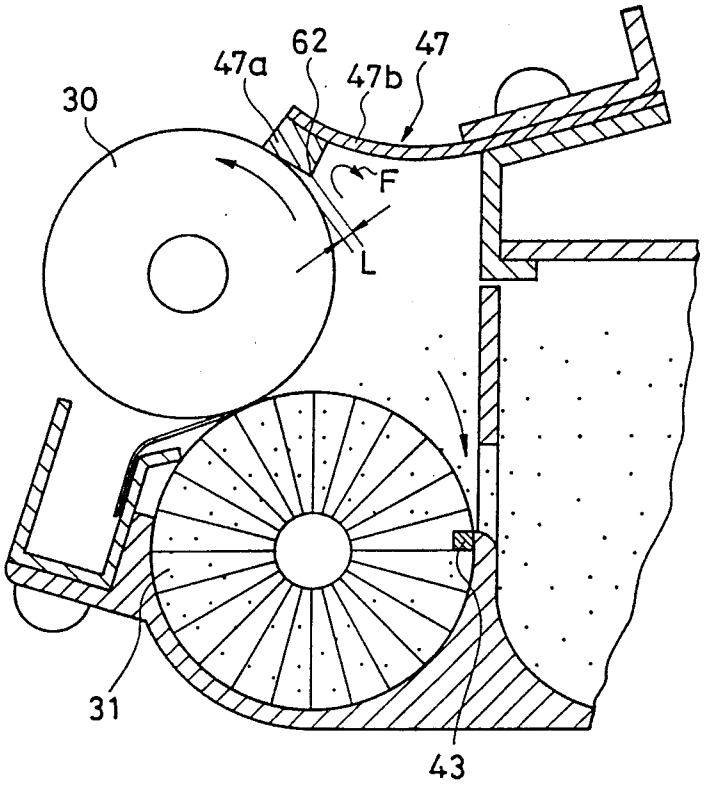
FIG. 11 is a cross-sectional view on an enlarged scale of the developing device in the third embodiment.

FIG. 10 is a cross-sectional view showing a third embodiment in accordance with the present invention. As shown in FIG. 10, elements similar to the elements of FIG. 9 are identified by like numerals, and the description for FIG. 9 is applied similarly. The plate 40*a* of the first supplying means 37 has an opening 40*c*. The shaft 39 is rotated counterclockwise. The thickness restriction means 47 for restricting the thickness of the developer layer, as shown in FIG. 11, is composed of the plates 47*a* and 47*b*. The plate 47*a* is adjusted so as to separate from the developing roller 30 with a small distance L (L is preferably from 0.05 to 0.5 mm) at a corner 62. The plate 47*a* has a predetermined thickness so that the plate 47*b* parts or separates from the surface of the developing roller 30. The circumferential speed of the fur brush 31 is selected to be equal to that of the developing roller 30. An AC voltage superimposed on a positive DC voltage is applied across the developing roller 30 and the fur brush 31 by the voltage applying means 53, thereby to adjust the thickness of the developer 28 electrified on the surface of the developing roller 30.

Operation of the third embodiment is elucidated hereinafter. In the third embodiment, a thick layer of the developer 28 over a predetermined thickness can be coated on the developing roller 30 by pulsating the current of the first voltage applying means 53 wherein an AC voltage is superimposed on the DC voltage. The developer 28 adhering to on the surface of the developing roller 30 after the developing step is vibratingly moved between the fur brush 31 and the developing roller 30 by the effect of the AC voltage, and thereby the ghost on the developing roller 30 is erased, and condensation of the developer 28 is prevented, moreover the high adhering force of the developer 28 on the developing roller 30 can be reduced. As a result, a high quality image having no ghost is obtainable.

As shown in FIG. 11, the superfluous developer 28 on the developing roller 30 is scraped by a corner 62 of the plate 47*a*, the thickness of the developer 28 is evened to a predetermined thickness corresponding to a distance L between the surface of the developing roller 30 and the corner 62. Subsequently, the developer 28 on the developing roller 30 is scraped by the contacting surface of the plate 47*a* of the thickness restriction means 47, and the thickness of the developer 28 is restricted to the predetermined value. The developer 28 scraped by the corner 62 of the plate 47*a* is carried upward along a vertical wall of the corner 62 as shown by an arrow F and falls on the brush 31.

In the embodiment shown in FIG. 10, the shaft 39 of the first supplying means 37 is rotated counterclockwise, thereby the developer 28 in the developer storing container 35 is gathered in the right portion of the developer storing container 35 by the plates 40*a* and 40*b*. As a result, the developer is not present in the vicinity of the opening 42. The developer 28 falling on the fur brush 31 is scraped by the scraper 43 and is returned to the developer storing container 35 through the opening 42. The developer 28 returned in the developer storing container 35 is transferred rightward (FIG. 10) by the plate 40*b* through the opening 40*c* of the plate 40*a*. Consequently, overelectrification of the developer 28 is prevented and the scraping effect of the scraper 43 is improved.

Figure 12:
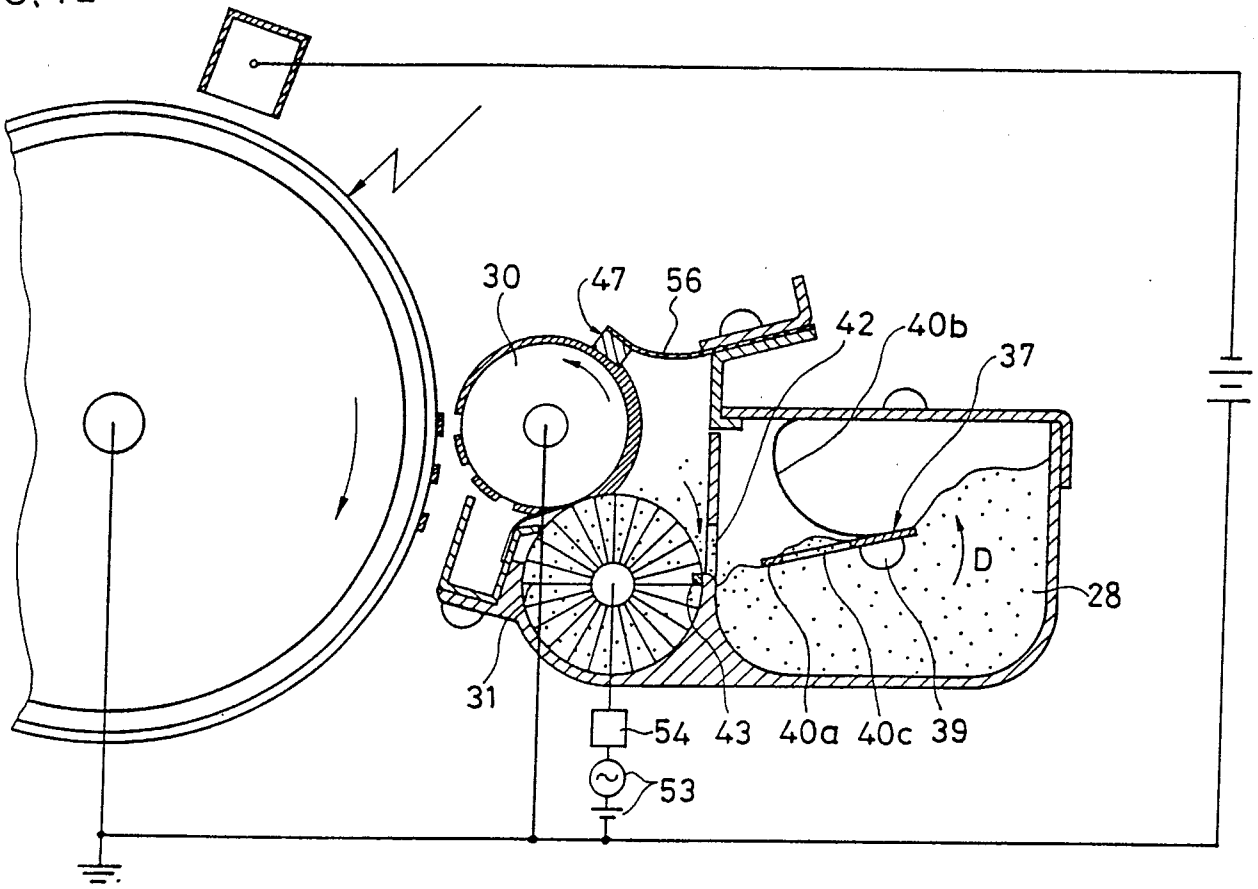
FIG. 12 is a cross-sectional view showing a main portion of the developing device in a fourth embodiment.

FIG. 12 is a cross-sectional view showing a fourth embodiment in which elements similar to the elements of FIG. 9 are idenfified by like numerals. Furthermore, the first voltage applying means 53 and the first supplying means 37 are identical with that of the third embodiment. A voltage which is higher than a predetermined voltage is applied across the developing roller 30 and the fur brush 31 for an initial predetermined time period by the first voltage applying means 53. Then after the initial predetermined time period, the voltage is reduced to the predetermined value. The thickness restriction means 47 is made of a solid member of stainless steel, stainless steel coated by fluorine plastic, solid plastic, ceramics or the like, and is pressed against the developing roller 30 by an elastic force of a spring 56.

Operation of the fourth embodiment is elucidated hereinafter.

In the embodiment, the amount of the developer 28 which is supplied from the fur brush 31 is increased by increasing the voltage which is applied for the initial predetermined time period, and thereby reduction of the image intensity in the initial stage of developing and thereafter is prevented. Furthermore, the thickness restriction means 47 is made of a solid member of metal, and thereby a smoother surface than that of rubber is obtainable. When the thickness restriction means 47 is in contact with the surface of the developing roller 30, an even thin and stripe-free layer of the developer 28 can be formed.

In the embodiment, an AC voltage is superimposed on the DC voltage in the first voltage applying means 53, and thereby the developer 28 adhering to the surface of the developing roller 30 is vibrated between the fur brush 31 and the developing roller 30 by the AC voltage after the developing step. As a result, the ghost on the developing roller 30 is erased. Moreover, solidification of the developer 28 is prevented, and a high adhering force of the developer 28 to the developing roller 30 is prevented, thereby a high quality image having no ghost is obtainable.

Figure 13:
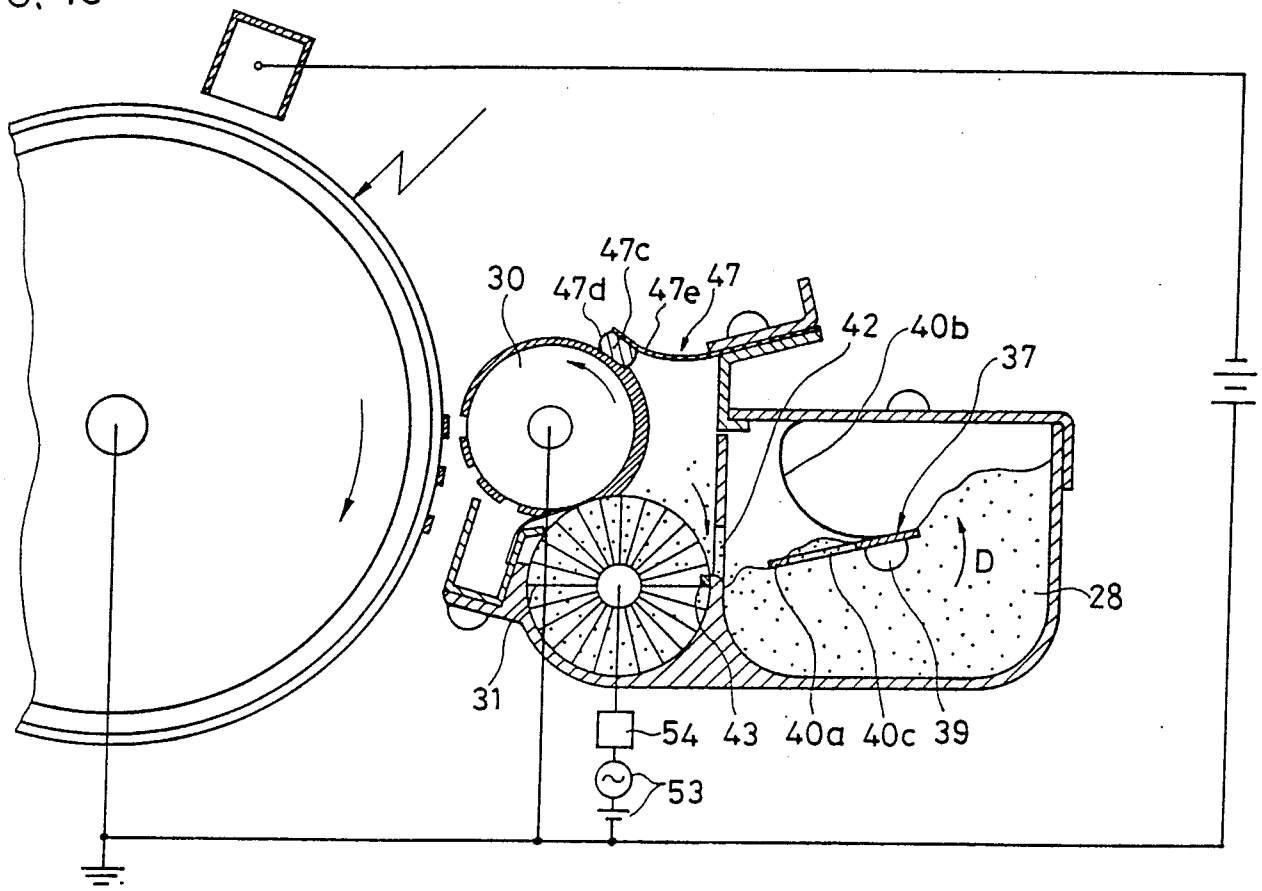
FIG. 13 is a cross-sectional view showing a main portion of the developing device in a fifth embodiment.

FIG. 13 is a cross-sectional view showing a fifth embodiment in which elements similar to the elements of FIG. 4 are identified by like numerals. In the embodiment, a voltage of the first voltage supplying means 53 is progressively increased during the initial stage of operation so that the electrified developer 28 on the fur brush 31 is constantly supplied to the developing roller 30. The thickness restriction means 47 consists of a sealed pouch 47*d* confining a fluid 47*c* such as air therein. The pouch 47*d* is made of urethane sheet and is fixed on a lower surface of the end portion of the plate 47*e* made of urethane rubber. A gast such as nitrogen, a liquid such as water, a low molecular weight organic liquid such as ethylene glycol, a polymer diverging liquid, or high polymer liquid are usable as replacements for the air confined therein. The pouch 47*d* can be made of a plastic sheet such as polyethyleneterephthalate. Teflon, vinyl choloride resin, or other rubber sheet material is usable. The plate 47*e* can be made of an elastic material such as spring steel, plastic or rubber, or a solid material such as aluminum, steel or plastic.

Operation of the fifth embodiment is elucidated hereinafter.

As shown FIG. 13, a voltage, which is applied across the developing roller 30 and the fur brush 31 by the first voltage applying means 53, is progressively increased from a voltage which is lower than a predetermined voltage to the predetermined voltage. As a result, when the voltage is applied and thereafter, the electrified developer 28 on the fur brush 31 can be constantly supplied to the developing roller 30, and is coated evenly on the surface of the developing roller 30. The contacting part of the thickness restriction means 47 contacting the developing roller 29 is the pouch 47*d* enclosing a fluid therein, the pouch 47*d* evenly contacting the developer 28 on the developing roller 30. Furthermore, the contact pressure between the surface of the developer 28 and the pouch 47*d* can be held at a constant value. Consequently, a high quality and even image is obtainable.

Figure 14:
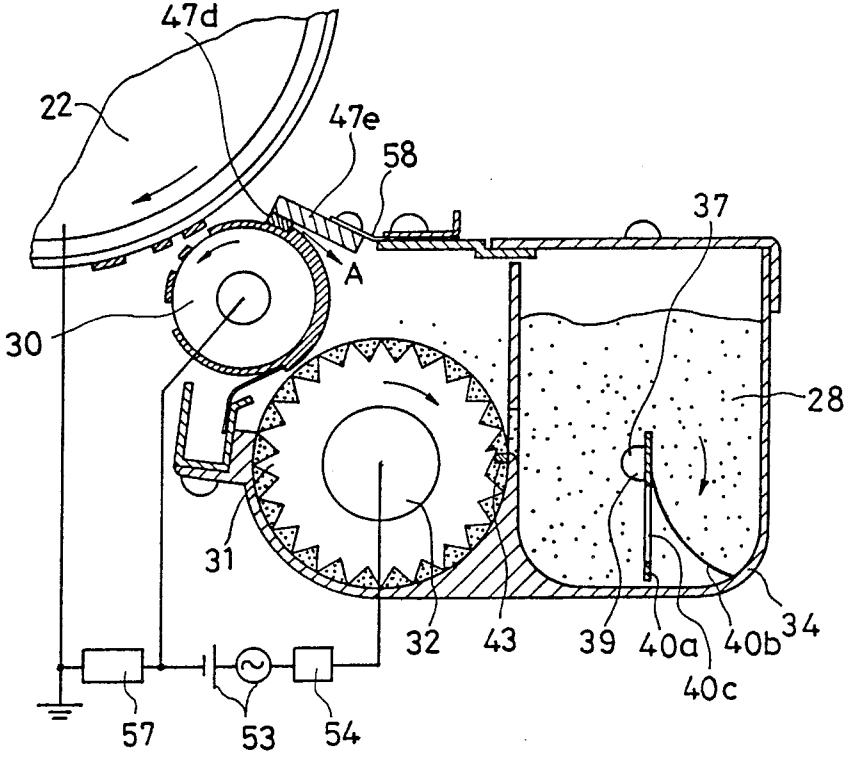
FIG. 14 is a cross-sectional view showing a main portion of the developing device in a sixth embodiment.

FIG. 14 is a cross-sectional view showing a sixth embodiment. The first supplying means 37 is identical with that of the second embodiment. Other elements similar to the elements of FIG. 5 are identified by like numerals in the embodiment. A cylindrical elastic member 31 is made of electroconductive sponge, which is mounted around a shaft 32 of aluminum. In the above-mentioned constitution, the elastic member 31 has a function of electrifying by friction and supplying the developer on the developing roller 30 as shown in the first embodiment. The elastic member 31 is disposed in parallel with the developing roller 30 with a predetermined spacing of interval (0.1 –0.5 mm is recommended). According to the experiment by the inventors, the developer 28 electrified by the voltage of the first voltage applying means 53 can be transferred to the developing roller 30 in spite of the predetermined interval. A bias voltage applying means 57 applies a DC bias voltage across the photoreceptor drum 22 and the developing roller 30.

Thickness restriction means 47 comprises the pouch 47*d* made of urethane sheet enclosing air therein which is fixed on one end of a solid plate 47*e* made of stainless steel. The plate 47*e* is pressed against the developing roller 30 by a sheet-shaped spring 58 made of an elastic material such as spring steel, plastic or rubber. The pouch 47*d* contacts the surface of the developing roller 30 between both the contact portions of the developing roller 30 against the photoreceptor 22 and the elastic member 31 and at a position in advance of the contact region of the photoreceptor 22. The plate 47*e* is mounted at a position of the housing 34 wherein the pouch 47*d* tends to separate or part from the surface of the developing roller 30 by friction against the surface of the developing roller 30 during rotation of the developing roller 30. Moreover, the pouch 47*d* has a predetermined height so that the plate 47*e* maintains a predetermined spacing or interval relative to the surface of the developing roller 30.

Operation of the sixth embodiment is elucidated hereinafter. The pouch 47*d* contacts the surface of the developing roller 30 in parallel with the axis of the developing roller 30, since the plate 47*e* of the thickness restriction means 47 is made of a solid metal member. Moreover, since an interval is maintained between the surface of the developing roller 30 and the plate 47*e*, the developer 28 scraped by the pouch 47*d* is moved upward along the vertical wall of the pouch 47*d* as shown by an arrow F in FIG. 11 and falls onto the cylindrical elastic member 30, and thereby the developer 28 is evenly supplied on the developing roller 30. When the developer 28 on the developing roller 30 faces the electrostatic latent image of the photoreceptor drum 22, the developer 28 transfers to the electrostatic latent image through a combined effect of the electrostatic force of the electrostatic latent image and an electric field of the DC bias voltage which is applied across the photoreceptor drum 22 and the developing roller 30 by the bias voltage applying means 57. An AC voltage or a DC voltage superimposed on an AC voltage is usable in the embodiment.

Figure 15:
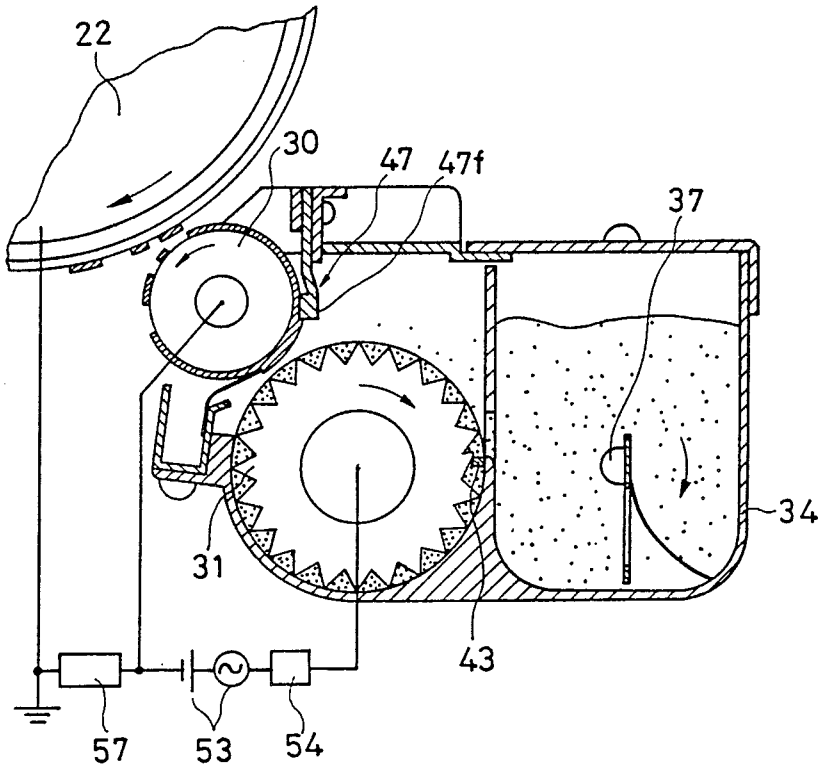
FIG. 15 is a cross-sectional view showing a main portion of the developing device in a seventh embodiment.

FIG. 15 is a cross-sectional view showing a seventh embodiment in which elements similar to the elements of FIG. 6 are identified by like numerals. The thickness restriction means 47 comprises an elastic plate 47*f*. The materials of the plate 47*f* are identical with those of the first embodiment. The plate 47*f* contacts the surface of the developing roller 30 at a position between both the contact portions of the developing roller 30 against the photoreceptor 22 and the elastic member 31 and prior to a facing to the photoreceptor 22 during rotation of the developing roller 30. The thickness restriction means 47 is mounted on the housing 34 at a position receiving a force so as to press it against the surface of the developing roller 30 by friction with the developing roller 30 during rotation of the developing roller 30.

Operation of the seventh embodiment is elucindated hereinafter. As shown in FIG. 15, since the plate 47*f* tends to approach the surface of the developing roller 30, accumulation of the developer 28 inbetween the developing roller 30 and the plate 47*f* is prevented. Accordingly, solidification of the developer 28 is effectively prevented. Since the thickness restriction means 47 is apart from the surface of the developing roller 30, the developer 28 electrified on the developing roller 30 does not transfer to the thickness restriction means 47, and the developer 28 is evenly coated on the developing roller 30.

Figure 16:
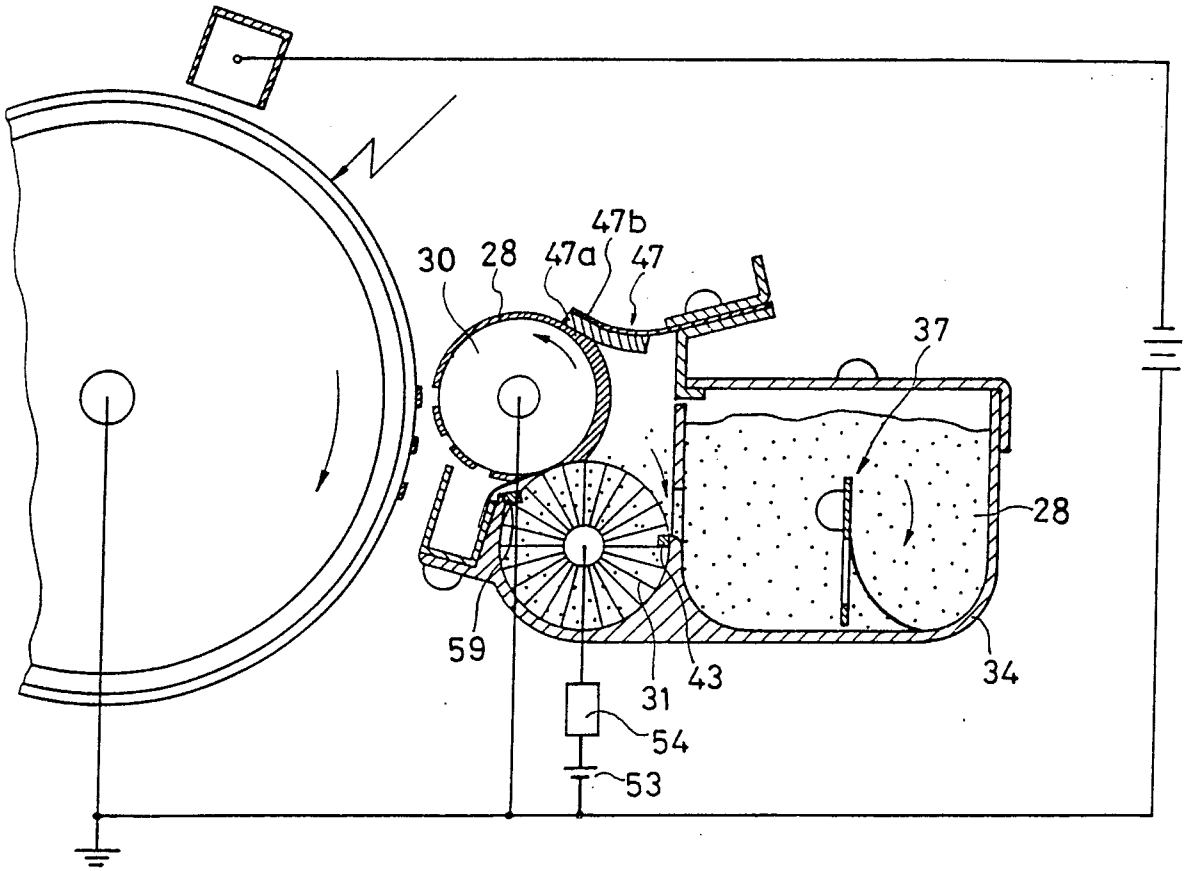
FIG. 16 is a cross-sectional view showing a main portion of the developing device in an eighth embodiment.
Figure 17:
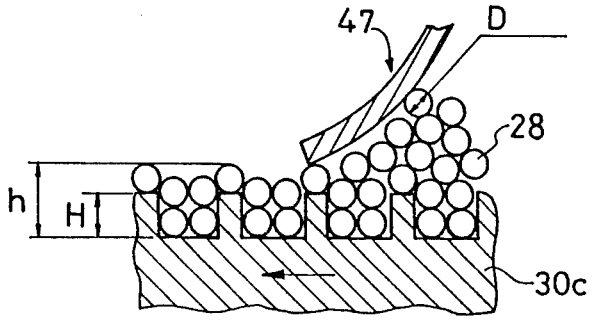
FIG. 17 and FIG. 18 are cross-sectional views showing the operation of a thickness restriction means.
Figure 18:
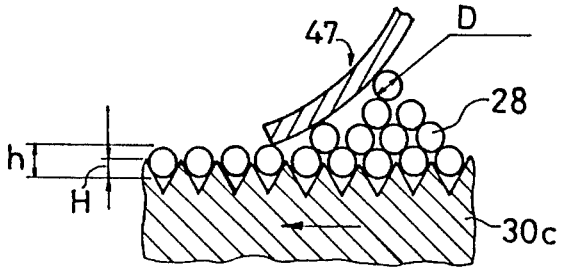

FIG. 16, FIG. 17, FIG. 18 and FIG. 19 show the eighth embodiment. As shown in FIG. 16, where elements similar to the elements of FIG. 9 are identified by like numerals. In the embodiment, as shown in FIG. 5, both the end portions 30*a* and 30 *b* of the developing roller 30 have smooth surfaces, and the surface of the central portion 30*c* has a rough surface. FIG. 17 and FIG. 18 are cross-sectional views of the developing roller 30 on an enlarged scale. As shown in FIG. 17 and FIG. 18, when an average diameter of the developer 28 particles is designated by D, an average thickness of the developer 28 is designated by h and an average depth of hollows in the surface is designated by H, and the average depth H is selected as shown by the relationship shown by the following equation:

$$0 \leqq h - D \leqq H.$$

The depth H of the hollow is the distance from the bottom to the surface of the hollow on the rough surface of the hollow on the rough surface of the developing roller 30.

Figure 19:
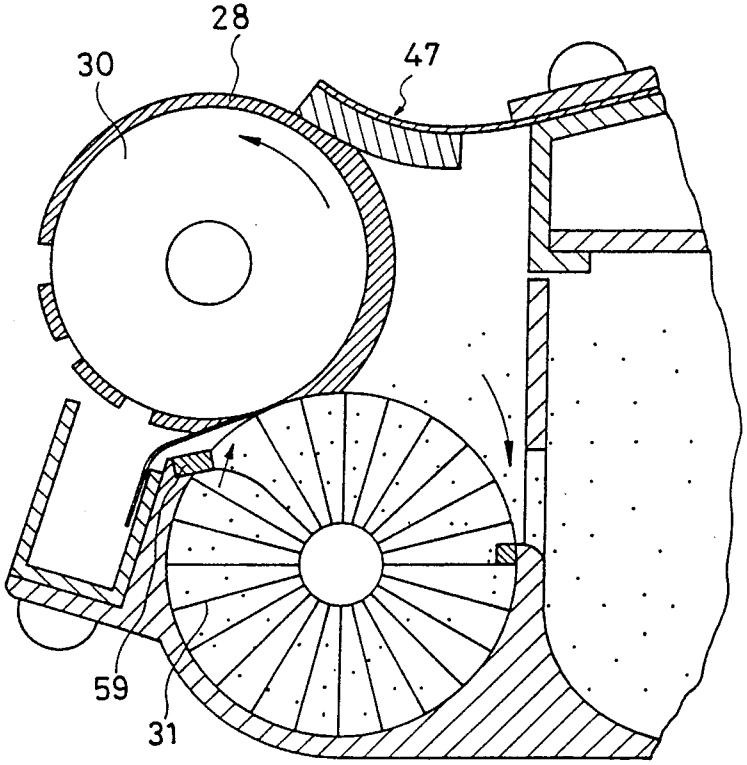
FIG. 19 is a cross-sectional view on an enlarged scale showing operation of the developing device in the eighth embodiment.

As shown in FIG. 16, a plate 59 for scattering or sputtering the developer 28 onto the developing roller 30 is composed on the housing 34 in one body. The plate 59 is disposed at a position touching the fur brush 31 at a position in advance of the contact region of the developing roller 30 and the fur brush 31 during rotation of the fur brush 31, thereby the top portion of the fur brush 31 is bent by the plate 59 as shown in FIG. 19.

Operation of the eighth embodiment is elucidated hereinafter. As shown in FIG. 16, when the rotating fur brush 31 contacts the plate 59, the fur brush 31 is bent. When the fur brush 31 passes the plate 59, the fur brush 31 bent by the plate 59 returns to an original shape, and scatters the developer 28 to the developing roller 30 as shown in FIG. 19. As a result, solidification of the developer 28 is prevented, and hence the rise-up time for forming a predetermined thickness of the developer 28 is reduced. Moreover, leakage of the developer 28 is prevented by the plate 59.

A thickness of the developer 28 on the developing roller 30 is restricted to a sum of the depth of the hollow and the diameter of the developer 28 adhering directly on the surface of the developing roller 30. Therefore, an image having fine lines is reproduced by the developer 28 adhering directly to the developing roller 30. Moreover, an image having an even density is obtainable by holding a constant amount of the developer 28 in the hollows.

Figure 20:
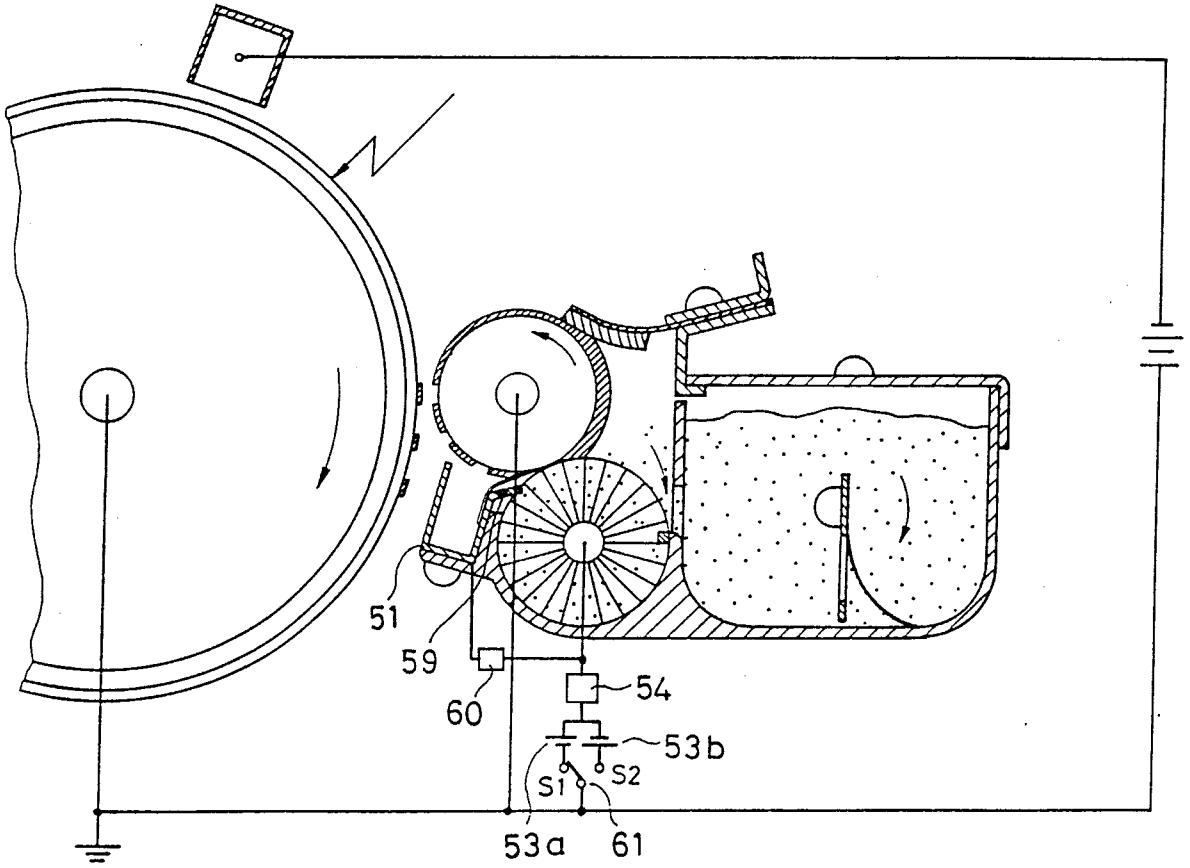
FIG. 20 is a cross-sectional view showing a main portion of the developing device in a ninth embodiment.

FIG. 20 is a cross-sectional view showing a ninth embodiment.

As shown in FIG. 20, where elements similar to the elements of FIG. 8 are identified by like numerals. A DC voltage is applied across the developing roller 30 and the plate 59 in order to scatter the developer 28 to the developing roller 30 by a second voltage applying means 60. In the embodiment, though the second voltage applying means 60 is a DC power supply, a power supply wherein AC voltage is superimposed on the DC voltage is usable. Moreover, the plate 59 is formed as part of the U-shaped leak preventing member 51. A common contact 61 of a magnet relay is switched to a contact S1 when the developing device is in operation and is switched to a contact S2 when the developing device is not in operation. When the magnet relay 61 is switched to the contact S2, a voltage having a reverse polarity is applied across the developing roller 30 and the fur brush 31.

In the embodiment, since the voltage is applied across the developing roller 30 and the plate 59 by the second voltage applying means 60, the amount of the developer 28 which is scattered by the fur brush 31 is controlled. Moreover, when the developer 28 is transferred from the fur brush 31 to the developing roller 30 by the electric field between them, the developer 28, which is not electrified or is electrified in reverse polarity, has a low probability of being transferred; only the developer 28 electrified normally is transferred and contributes to the development. As a result, a high quality image is obtainable. When the developing device is out of operation, a voltage having a reverse polarity is applied across the developing roller 30 and the fur brush 31 by switching the contact 61, and thereby the surplus developer 28 on the developing roller 30 is attracted to the fur brush 31 by the electric field, and the ghost on the developing roller is erased. Furthermore, since the developer 28 does not remain on the developing roller 30, the developer is not influenced by humidity conditions or the like.

The developing device in accordance with the present invention is not restricted within only the foregoing nine embodiments as mentioned above, and other constitutions by combination of the respective means such as electrification of the developer, coating on the developing roller and restriction of the thickness of the developer are available. The present invention is suitable to a non-magnetic one-component developer, and is advantageous in developing of a color image which is stacked up with a plurality of the developers on the charge holding member, since the developing roller does not contact the charge holding member.

As mentioned above, the present invention has a simple constitution wherein a circulating means for operating a flow-in or flow-out of the developer between the developer holding means and the first developer supplying means, thereby over-electrification of the developer is prevented and a high quality image is obtainable.

What is claimed is:

1. A developing device comprising:

an electrophotographic light-sensitive member having an electrostatic latent image, a developer storing means for storing developer therein, developer carrying means for carrying developer to said electrophotographic light-sensitive member from said developer storing means comprising an endless-type developer carrying member and a second supplying means including a cylindrical elastic member contacting said developer carrying member for supplying developer to said developer carrying member and for returning superfluous developer at least adjacent to a contact part of said rotating cylindrical elastic member and said developer carrying means on the downstream portion from said contact part of said developer storing means, first supplying means installed in said developer storing means for supplying said developer to said developer carrying means, and developer returning means for returning developer from said developer carrying means to said developer storing means.

2. A developing device in accordance with claim 1, wherein said developer returning means comprises a partition having an opening for passing developer to said developer storing means disposed between said first supplying means and said cylindrical elastic member.

3. A developing device in accordance with claim 1, wherein said first supplying means comprising at least one plate which moves upward in the developer storing means, an end portion of said plate in contact with an inner wall of said developer storing means.

4. A developing device in accordance with claim 1, wherein said first supplying means comprising at least two plates, and an angle between said plates is varied by a load of developer in supplying operation.

5. A developing device in accordance with claim 1, wherein said developer carrying member has a rough surface defined by a plurality of hollows, the average depth H of the hollows of the rough surface determined by $0 \leqq h-D < H$, where h is the average thickness of the developer layer and where D is the average diameter of the developer particles.

6. A developing device in accordance with claim 1 further comprising:

first voltage applying means for applying a voltage across said developer carrying member and said second supplying means which controls the supply of the developer.

7. A developing device in accordance with claim 1 further comprising:

spattering means for supplying developer of said cylindrical elastic member to said developer carrying member, said spattering means disposed to contact a surface portion of said moving cylindrical elastic member to effect spattering prior to that surface portion contacting said developer carrying member.

8. A developing device in accordance with claim 7, wherein a voltage is applied across said spattering means and developer carrying member.

9. A developing device in accordance with claim 1 further comprising:

a scrapper for scraping surplus developer from said cylindrical elastic member.

10. A developing device in accordance with claim 8, wherein said developer carrying member contacts said cylindrical elastic member and moves in the same direction as said cylindrical elastic member and at a slower speed than that of said cylindrical elastic member.

11. A development device in accordance with claim 1 further comprising:

thickness restriction means in contact with said developer carrying member at one edge portion thereof and having a deviation from a linear line of no more than 0.15 mm, said thickness restriction means adjusting the thickness of the developer on said developer carrying means.

12. A developing device in accordance with claim 11 wherein said thickness restriction means comprises a contact member contacting said developer carrying member and a holding member holding said contact member in contact with said developer carrying member.

13. A developing device in accordance with claim 12, wherein a leading edge of said contact member with respect to the direction of rotation of said developer carrying member is spaced from said developer carrying member to define a predetermined gap relative to said developer carrying member.

14. A developing device in accordance with claim 1, further comprising scatter preventing means for preventing the scattering of developer, said scatter preventing means installed at a position in advance of the nip defined between said developer carrying member and said cylindrical elastic member.

15. A developing device in accordance with claim 14, wherein said scatter preventing means comprises a U-shaped scatter preventing member and a scatter preventing sheet which is fixed on said scatter preventing member at one end thereof and touches the surface of said developer carrying member at another end.

16. A developing device in accordance with claim 15, wherein said scatter preventing sheet is a rubber sheet having a thickness from 50 microns to 200 microns.

17. A developing device in accordance with claim 15, further comprising:

sealing members for preventing the scattering of developer disposed on both end surfaces of said developer carrying member and pressing against said developer carrying member through said scatter preventing sheet.

18. A developing device in accordance with claim 17 wherein said seal members are fabricated from an elastic material selected from rubber, sponge, cloth, and nonwoven fabric.

19. A developing device comprising:

an endless developer carrying means, a cylindrical elastic member for supplying developer to said endless developer carrying means and contacting said rotating endless developer carrying means, and an inner surface of a curved casing extended from the bottom of said developer storing means, an elastic blade for adjusting the thickness of the developer of said developer carrying means to a predetermined value by contacting said developer carrying means at a position on the surface thereof before the developer of said developer carrying means is transferred to an electrophotographic light-sensitive member, a supplying means for supplying developer to said cylindrical elastic member, installed in a developer storing container, a scraper for scraping superfluous developer on the surface of said cylindrical elastic member, to even said developer on the surface of said cylindrical elastic member, and a partition disposed between said cylindrical elastic member and said supplying means, contacting said cylindrical elastic member at a position being lower than a lower end of an opening for passing developer across said developer storing container and said cylindrical elastic member therethrough disposed on a portion of said partition being upper than the bottom of said cylindrical elastic member.

* * * * *